US005098469A

United States Patent [19]

Rezhets

[11] Patent Number: 5,098,469

[45] Date of Patent: Mar. 24, 1992

[54] POWDER METAL PROCESS FOR PRODUCING MULTIPHASE NI-AL-TI INTERMETALLIC ALLOYS

[75] Inventor: Vadim Rezhets, West Bloomfield, Mich.

[73] Assignee: General Motors Corporation, Detroit, Mich.

[21] Appl. No.: 758,138

[22] Filed: Sep. 12, 1991

[51] Int. Cl.[5] ..... B22F 9/00

[52] U.S. Cl. ..... 75/249; 419/32; 419/38; 419/54; 419/60; 419/47

[58] Field of Search ..... 75/249; 419/32, 38, 419/54, 60, 47

[56] References Cited

U.S. PATENT DOCUMENTS

| | | | |
|---|---|---|---|
| 2,755,184 | 7/1956 | Turner, Jr. et al. | 75/224 |
| 2,877,113 | 3/1959 | Fitzer | 75/211 |
| 4,834,941 | 5/1989 | Shiina | 75/249 |
| 4,867,806 | 9/1989 | Shiina | 75/249 |

OTHER PUBLICATIONS

Bose et al., "Potential of Powder Injection Molding and Hot Isostatic Pressing of Nickel Aluminide Matrix Composites", Industrial Heating, May 1988, pp. 38–41.

Sims et al., "Reactive Sintering of Nickel Aluminide", Materials Engineering Department Rensselaer Polytechnic Institute, Troy, New York 12180–3590, pp. 1–22.

*Primary Examiner*—Stephen J. Lechert, Jr.

*Attorney, Agent, or Firm*—George A. Grove

[57] ABSTRACT

A powder metallurgy process for producing near-net shape, near-theoretical density structures of multiphase nickel, aluminum and/or titanium intermetallic alloys is provided by employing pressureless sintering techniques. The process consists of blending a brittle aluminide master alloy powder with ductile nickel powder, so as to achieve the desired composition. Then, after cold compaction of the powdered mixture, the compact is liquid phase sintered. The four step liquid phase sintering process is intended to ensure maximum degassing, eliminate surface nickel oxide, homogenize the alloy, and complete densification of the alloy by liquid phase sintering.

10 Claims, 1 Drawing Sheet

POWDER METAL PROCESS FOR PRODUCING MULTIPHASE NI-AL-TI INTERMETALLIC ALLOYS

The present invention generally relates to a powder metallurgy process for producing articles from multiphase nickel, aluminum and/or titanium (Ni-Al-Ti) alloys. More particularly, this invention relates to such a powder metallurgy process which is characterized by a four step liquid phase sintering process, and wherein the articles produced by such a process are characterized by being near-net shape and near-theoretical density.

BACKGROUND OF THE INVENTION

Intermetallic compounds are well suited for high performance and high temperature applications, such as engine applications, because of their high strength at elevated temperatures and good oxidation resistance. For example, nickel aluminides such as $Ni_3Al$ and NiAl possess excellent oxidation resistance and strength at high temperatures. In addition, the light-weight titanium aluminide, $Ti_3Al$, offers attractive strength-to-weight and elastic modulus-to-weight ratios.

Despite these advantages, commercial growth of these aluminide alloys has been hampered. This is due primarily to the intrinsic brittleness of these polycrystalline intermetallic compounds. Previous research has generally focused on improving the single phase aluminide alloys and/or alloy additions to such single phase alloys, for improvement of the much-needed room temperature ductility as well as for retention (or enhancement) of high temperature strength.

An alternative approach for achieving similar improvements in physical characteristics by optimizing the characteristics of the diverse aluminides, has been to employ multiphase Ni-Al-Ti systems which contain various combinations of the $Ni_2AlTi$, $Ni_3(Al,Ti)$ and Ni(AlTi) phases. Multiphase Ni-Al-Ti alloys which were induction melted, and then cast, have shown excellent strength in compression over the temperature range from room temperature up to about 1000° C., with corresponding room temperature compressive ductility of about 0.4% to about 15%. This is a substantial improvement over the single-alloy aluminide systems. Within these multiphase Ni-Al-Ti systems, it is believed that optimum properties were obtained with alloys consisting of the $Ni_2AlTi$ and $Ni_3(Al,Ti)$ phases, with the room temperature ductility being directly related to the amount of $Ni_3(Al,Ti)$.

However these cast alloys did not have a uniform phase distribution nor uniform grain size, even after 50 hours of homogenization at about 1150° C., indicating widespread chemical segregation within the alloy. These are typical problems associated with castings although they appear to be more severe for these multiphase Ni-Al-Ti intermetallic aluminide alloys. Therefore, it would be desirable to provide a method for forming these multiphase Ni-Al-Ti alloys which does not employ traditional casting techniques.

Powder metallurgy processing has the potential to eliminate the disadvantages inherent in the Ni-Al-Ti castings since this technique generally produces an alloy with uniform composition and phase distribution, as well as fine grain size, thereby improving the ductility of the alloy at room temperature. For these reasons, powder metal processing, which utilizes hot compaction methods, i.e., hot extrusion or hot isostatic pressing (HIPing) of atomized prealloyed powders, has been the primary method to produce single phase intermetallic aluminide alloys.

Nevertheless, there has been limited success with the multiphase alloys. Also, these conventional powder metallurgy processes are characterized by being relatively costly. In particular, the atomized Ni-Al-Ti powders are expensive. Further, the hot consolidation processes are time consuming and require expensive canning and decanning steps, yet have been necessary to achieve sufficient green strength and density within the compact because of the brittle nature of aluminide alloy powders, which prevents the use of conventional compaction techniques. (While acceptable compaction can be accomplished using plasticizers added to the powder, the properties of alloys after sintering are usually much lower with this procedure.) Lastly, any parts with complicated geometry still require costly machining steps since aluminide alloys are relatively difficult to machine except for by grinding.

Therefore what is needed is a method for producing these multiphase Ni-Al-Ti aluminide alloys which preferably employs powder metallurgy processing so as to obtain the benefits of this technology, but which does not require the use of atomized powders or hot isostatic consolidation processes. It would be even more desirable if the resulting article consisting of the Ni2AlTi and/or Ni(Al,Ti) and/or Ni3(Al,Ti) phases, formed from such a method, were near-net shape and characterized by a near-theoretical density, so as to minimize the subsequent machining of these hard materials.

SUMMARY OF THE INVENTION

It is an object of this invention to provide a method for producing multiphase Ni-Al-Ti alloys using powder metallurgy processing techniques, particularly multiphase alloys containing the $Ni_2AlTi$ and/or Ni(Al,Ti) and $Ni_3(Al,Ti)$ aluminide phases.

It is a further object of this invention that such a method produce articles which are characterized by near-theoretical density and near-net shape so as to potentially minimize the amount of final machining of the article.

Lastly, it is still a further object of this invention that such a method for producing multiphase Ni-Al-Ti alloys avoid the use of relatively expensive procedures such as the use of atomized powders and hot consolidation processes.

In accordance with a preferred embodiment of this invention, these and other objects and advantages are accomplished as follows.

According to the present invention, there is provided a powder metallurgy process for producing near-net shape, near-theoretical density structures of multiphase Ni-Al-Ti intermetallic aluminide alloys by employing pressureless, liquid phase sintering techniques. The process consists of blending ductile nickel powder with a prealloyed brittle aluminide master alloy powder that contains either nickel aluminide and/or titanium aluminide. The powders are mixed in proportion to the desired end composition. After conventional compaction of the powdered mixture, the compact is then liquid phase sintered.

The four step sintering process of this invention maximizes (1) the degassing of the compact, (2) eliminates surface nickel oxide, (3) homogenizes the alloy, and (4) completely densifies the alloy compact by liquid phase sintering. The proper execution of all four processing steps results in the formation of a critical amount of liquid phase during sintering, about 30 to 35% liquid phase.

Using this method, high green strength is obtained within the sintered article without the use of binders. In addition, the sintered article is characterized by a near-net final shape and near-theoretical density. For example, articles of various geometry were produced with excellent retention of geometry and having a density of about 98% to 99% of the theoretical density. In addition, alloys produced by this process have exceptional room temperature ductility, about 15%, in compression and high compressive yield strength at elevated temperatures.

A particularly advantageous feature of the method of this invention is that this process will eliminate costly machining and facilitate production of components from the multiphase Ni-Al-Ti alloys for use in high temperature applications, such as advanced engines.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawing wherein.

DETAILED DESCRIPTION OF THE INVENTION

Figure 1:
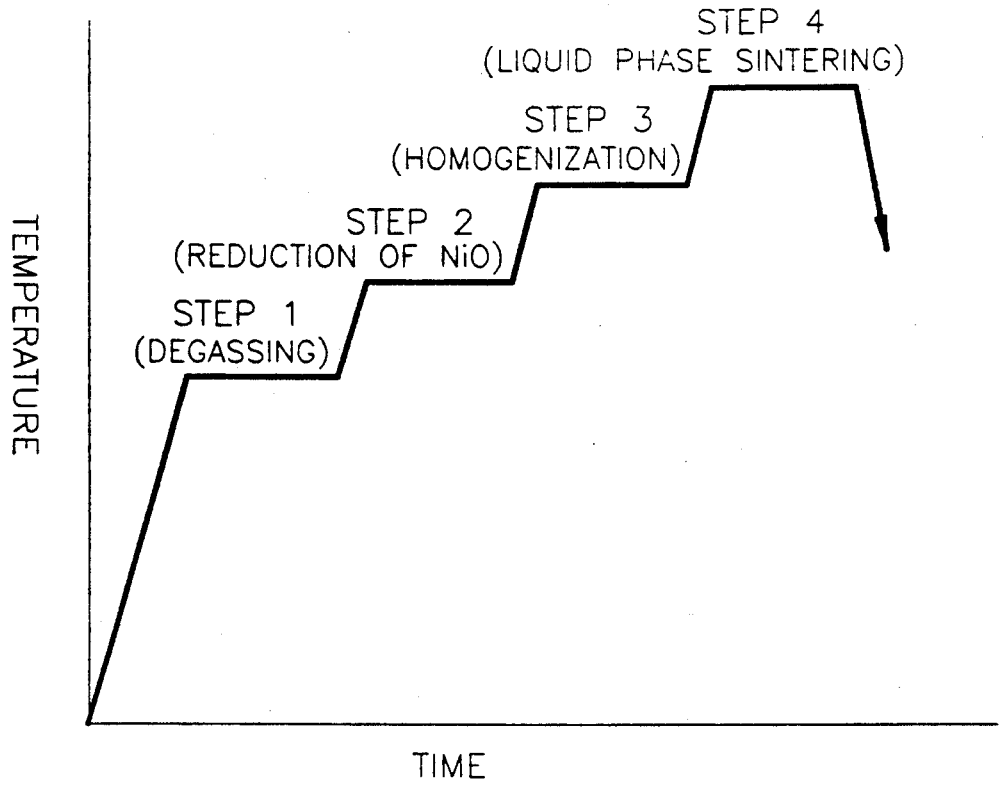
FIG. 1 schematically shows the four isothermal steps employed in the sintering process of this invention.

A powder metallurgy process is provided for producing near-net shape, near-theoretical density structures of multiphase Ni-Al-Ti intermetallic alloys, particularly the $Ni_2AlTi$ and/or Ni(Al,Ti) and $Ni_3(Al,Ti)$ phases. The powder metallurgy process of this invention employs a four-step, pressureless sintering technique.

Prior to the pressureless sintering of the desired article, the appropriate powdered mixture must be formed. The powdered mixture is chosen so as to result in the desired Ni-Al-Ti composition. The particular Ni-Al-Ti composition was produced by blending ductile nickel powder (99.9 weight percent nickel) with brittle prealloyed titanium-aluminum (Ti-Al) powder. Alternatively, the ductile nickel powder may be mixed with a mixture of Ti-Al and nickel-aluminum (Ni-Al) powders, depending on the desired composition of the resultant sintered article. A particularly advantageous feature of the method of this invention is that it is readily adaptable to a range of compositions.

The use of both a ductile nickel powder and a brittle prealloyed aluminide powder, is to ensure sufficient green strength and density within the subsequently-pressed powder compacts, without the use of additional plasticizers. This is achieved by mechanical interlocking of the angular prealloyed powder with the spiky surface of the ductile nickel powder, and by concurrent embedding of the brittle prealloyed powder into the ductile nickel powder.

The nickel powder was commercially available from International Nickel Company, as INCO type 123, and was produced by a thermal decomposition refining process. The size of most of the nickel particles was in the range of about three to seven microns.

The prealloyed Ti-Al powder used was approximately 65 weight percent titanium and 35 weight percent aluminum. The prealloyed Ni-Al powder used was approximately 50 weight percent nickel and 50 weight percent aluminum. The composition of these powders may vary, if desired, from 100% of a single component to 100% of the other component, although the benefits of this invention may be diminished at these extreme levels, as well as by the inclusion of three metal components (i.e., Ni, Al, and Ti or substitutions of cobalt, Co, and/or molybdenum, Mo, and/or niobium, Nb). Therefore, the exact composition of the initial powders will depend on the desired final composition. Thus, the teachings of this invention are not to be limited only to the compositions specified.

In particular, the specific compositions of the sintered articles which were studied for purposes of this invention, were characterized by about thirty to sixty percent of the $Ni_3(Al,Ti)$ phase, with the remainder being substantially the $Ni_2AlTi$ phase, although at higher concentrations of the $Ni_3(Al,Ti)$ phase the Ni(Al,TI) phase is more stable and tends to exist more often than the $Ni_2AlTi$ phase. This range of compositions tended to optimize the liquid phase formation during sintering thereby resulting in optimized properties within the sintered article.

The prealloyed powders, whether the Ti-Al or the Ni-Al powders, were obtained from Consolidated Astronautics Company. The prealloyed powders were characterized by a powder size of 100 mesh, or correspondingly the powder granules had a mean diameter of less than about 147 microns. These powders were produced by reaction sintering a blend of the appropriate elemental powders under protective atmosphere, and then grinding the sintered cakes, also under protective atmosphere. Powders produced by this process are generally less expensive than atomized prealloyed powders due to the less sophisticated processing techniques required as compared to atomization, although higher contamination and lower uniformity of powder size are inherent disadvantages of this powder production method.

Prior to blending of the prealloyed powders with the nickel powder, the prealloyed powder or mixture of prealloyed powders was ground in a ball mill to produce a particle size in the range of about two to about eight microns for most of the particles. This is not necessary however it facilitates a more intimate blending of the various powders during compaction. In addition, a particle size within this range of about two to about eight microns ensures a small initial pore size and active diffusion process during sintering, thereby enhancing the uniform distribution of phases within the sintered alloy. As stated, it is not absolutely necessary that the powders range between these sizes, however it is extremely desirable that they do so. Certainly, the powder granules should be less than about 10 to 15 microns so as to ensure homogeneity in the final sintered product.

It is also to be noted that if any micro- or macro-alloying elements or compounds, such as hafnium, niobium, boron, phosphorus, zirconium oxide, titanium boride or aluminum oxide, are to be added to the alloy, they should be added at this stage and blended within the ball mill.

When the prealloyed powders were ground within the ball mill, the preferred ratio of steel ball weight to powder weight for optimum grinding, with balls which were five to 12 millimeters in diameter, was approximately six to seven. The balls and powder occupied about 45% of the volume of the grinding mill. The grinding parameters may be modified, or substituted with other grinding techniques or even omitted, so long as the powders are characterized by a fine particle size.

For more uniform mixing and higher intensity grinding, hexane was added to the powders during grinding in a ratio of about one millimeter of hexane to about 1.2 grams of powder. The hexane enhances the grinding by forming a liquidus powdered mixture, thereby ensuring that even the fine particles will participate in the grinding and mixing action. Although hexane was employed, it is not necessary. In addition, other suitable alcohols, as well as heptane or acetone could be substituted for the hexane.

The rotation speed of the mill was approximately 70% of the critical speed; the critical speed being defined as that speed at which the balls are held against the outside wall of the container by centrifugal force. It is desirable to operate at less than critical speed so that the balls fall during rotation and thereby grind the particles upon impact. The prealloyed powder was ground for about 30 to about 48 hours under an atmosphere of high purity argon so as to prevent oxidation. After grinding, the powder was dried at about 70° C. in a vacuum to remove the hexane.

The ground prealloyed powder and the pure nickel powder were then blended in proper proportion to result in the desired composition. The composition of the powder mixture may vary considerably and is discussed later. The powders were blended using a conventional "Turbula" mixer containing a number of steel balls, each about 4.5 millimeters in diameter, for about sixty minutes. The powder and balls occupied about 45% and about 20% of the mixer volume, respectively. The addition of the steel balls during blending was preferred so as to break the agglomerates formed by the finely ground particles, thereby ensuring a more thorough blending of the constituents. Other suitable means for blending the powders could also be employed, so long as the powders are uniformly and intimately blended throughout.

The powder mixture was then compacted. Powder mixtures containing various ratios of the ductile nickel-to-brittle prealloyed powder were compacted in a double action floating die, wherein pressure is applied from both ends of the compacting container. The ratios of nickel-to-prealloyed aluminide powder varied from about 1.4 to about 3.4, and the compacting pressure varied between about 26,000 pounds per square inch (psi) to about 68,000 psi. (The powder mixture ratio and compacting pressures were varied so as to determine the optimum mixture and compacting parameters.) The walls of the compacting die were lubricated with butyl stearate (or other appropriate lubricant) to reduce the ejection force required for removal of the compact after compacting and to also reduce the wear on the dies.

The weight ratio of ductile nickel-to-brittle prealloyed aluminide powder varied from about 1.4 to about 3.4, with a powder mixture having ratio of 1.4 being characterized by less ductile material than a material having a ratio 3.4. Good compressibility and high green (or as-compacted) strength of the compact depended on maintaining this weight ratio of the ductile nickel to the brittle prealloyed Ni-Al-Ti master alloy as greater than or equal to about 1.5.

Within the range of this preferred ratio of ductile nickel-to-brittle aluminide powder, the compositions of the initial powdered mixture containing the brittle prealloyed aluminide powders and ductile nickel powder were as follows, in weight percents.

1. (65% Ti/35% Al)+(50% Ni/50% Al)+Ni
2. (53% Al/47% Ti)+Ni
3. (58% Ti/42% Al)+Ni

It is to be noted that the aluminum and titanium were added in prealloyed form because of their high affinity to oxygen in their elemental form. Therefore by adding the elements in a prealloyed form, the chance of oxidation by the aluminum and titanium was decreased, although it is not necessary to add either of these elements in a prealloyed form. The specific amounts of the prealloyed constituents varied depending on the desired ratio of elements within the final composition of the sintered article.

Further, other additional elemental additions were also tested as follows.

4. (53% Al/47% Ti)+Ni+Co
5. (53% Al/47% Ti)+Ni+Co+Mo
6. (53% Al/47% Ti)+Ni+Nb

Again, the range of compositions may vary so as to optimize the resultant properties of the sintered articles, while optimizing the amount of liquid phase formation during sintering.

The preferred ratio of ductile nickel to brittle aluminide powder varied between about 2.7 and 3.4, with about 3.0 being most preferred, as determined by the compacting pressure, and desired green strength and density, as discussed more fully later. A ratio of about three result in a powdered mixture having about three times the weight of ductile nickel powder as compared to the weight of the prealloyed brittle aluminide (Ni-Al and/or Ti-Al) powder, thereby resulting in the two-phase microstructure consisting of the $Ni_2AlTi$ and $Ni_3(Al,Ti)$ phases, wherein the relative concentration of the $Ni_3(Al,Ti)$ phase ranges between about thirty and about sixty percent, with the remainder being substantially the $Ni_2AlTi$ phase, although some Ni(Al,TI) phase may be present also at higher concentrations of the $Ni_3(Al,Ti)$ phase. This range of compositions tended to optimize the liquid phase formation during sintering thereby resulting in optimized properties within the sintered article. A particularly advantageous feature of this invention is that this ratio may vary considerably depending on the desired characteristics of the resultant sintered article.

The compacting pressure employed was determined by the maximum pressure withstood by the compact during compacting, before overpressing cracks were observed in the compact. Overpressing cracks were not observed for powder mixtures having a ratio of ductile nickel-to-brittle prealloyed powder ranging between about 1.4 to about 3.4 when using a compacting pressure of about 26,000 psi. Although at these ratios for the powder mixture, the compacts exhibited low green strength, which is the strength of the compacted material. The limiting compacting pressure, at which overpressing cracks were observed, increased with increasing ductile nickel-to-brittle prealloyed powder ratio, therefore indicating that the compacting pressure increased as the ductile component of the powder mixture increased. For example, overpressing cracks occurred at a pressure of about 42,000 psi for a ductile nickel-to-brittle prealloyed powder ratio of only about 1.4, while at ratios of about 2.7 to about 3.4 cracking was not observed with a compaction pressure of up to about 68,000 psi.

However, high compacting pressures, which increased the green density of the resultant compact, reduced the rate of degassing during sintering and in some instances prevented complete degassing due to trapped gases in closed pores. Consequently, a compaction pressure ranging between about 40,000 psi and about 45,000 psi, with about 42,000 psi being most preferred, was determined to be the optimum pressure when balancing these competing concerns. This compaction pressure produced good green strength and a green density within the compact of about 60 to 65% of theoretical. (The theoretical density was determined using a porosity-free sample obtained from a casting with the same composition as the powder metal alloy.) However, it is to be noted that the compacting pressure employed depends on the precise composition of the material and could be varied depending on the desired characteristics of the resultant sintered material.

After cold compaction of the powdered mixture, the compact was liquid phase sintered in accordance with this invention. The four step liquid phase sintering is shown schematically in FIG. 1, and includes four isothermal steps in a pressureless, vacuum environment so as to ensure maximum degassing, eliminate surface nickel oxide, homogenize the alloy, and completely densify the alloy by liquid phase sintering. Each step is required so as to obtain a uniform distribution of phases, fine grain size and near-theoretical density within the resultant Ni-Al-Ti multiphase alloy.

The first step of the four step liquid phase sintering process is the degassing step, and is represented by "Step 1" in FIG. 1. The compacts were heated in a vacuum to a temperature of about 1000° C. and held at this temperature for a duration sufficient to degass the compacts. The actual duration is dependent on the volume of parts within the furnace. The vacuum pressure must be sufficiently low so as to allow escape of the trapped gasses from within the porosity of the compacted powder, and was about $3\times10^{-5}$ torr, but a pressure of up to about $5\times10^{-4}$ torr would also be sufficient. Complete degassing of the open-pored compact occurs during this isothermal hold. Densification which would produce closed porosity within the compact and is therefore detrimental to the degassing process, does not occur in this step since diffusion within the powder mixture, particularly the prealloyed aluminide powder, is very slow at a temperature of about 1000° C. Therefore this step must occur at a temperature sufficient to degas the compact, about 950° C., but is dependent on actual composition of the compact and partial pressure of the chamber. However, this temperature must not be too high so as to cause significant diffusion within the compact which would result in closed porosity that would thereby prevent degassing of the compact. Therefore, the degassing temperature of step one should not exceed about 1050° C.

The second step represented by "Step 2" in FIG. 1 removes any nickel oxide which was present on the individual particles, surfaces within the compact. This is accomplished by increasing the temperature of the vacuum furnace to about 1150° C. at a rate of about 10° C. per minute. The duration at this temperature is also dependent upon the volume of the load within the furnace. During the duration at 1150° C., the nickel oxide at the surface is decomposed, and the product oxygen diffuses out of the compact. For this step to be successful, the vacuum in the furnace must be high enough to provide an oxygen partial pressure below the equilibrium oxygen partial pressure of about $1.9\times10^{-5}$ torr for the reaction:

$$Ni + 1/2O_2 \longrightarrow NiO.$$

Generally, within intermetallic compounds, a primary cause of excessive brittleness is due to the segregation of impurities in the grain boundaries. Within the multiphase Ni-Al-Ti alloys which are conventionally sintered in vacuum, the most detrimental impurity to the alloy is oxygen. To maintain the intergranular oxygen content as low as possible, the method of this invention maintains the vacuum pressure during Step 2 sufficiently below the equilibrium partial pressure of oxygen for the above chemical reaction. Therefore decomposition of oxide films on the surface of the nickel particles occur, which accelerates the diffusion processes during the subsequent homogenization step. In addition, some of the decomposition of the nickel oxide will occur by reduction of the nickel oxide with the aluminum or titanium so as to form aluminum oxide and/or titanium oxide plus elemental nickel.

The temperature for this second step must be high enough to reduce the nickel at a sufficiently rapid rate, and ranges between probably about 1100° C. to about 1200° C. It is to be noted that this second temperature may foreseeably be higher than 1200° C., however too high a temperature will close the porosity within the compact thereby detrimentally trapping the outgoing gases. It is imperative that the trapped gases be freed and the compact be totally degassed so as to obtain a high density within the sintered article.

It is noted that any additional oxides, such as aluminum oxide or titanium oxide, are present in lesser amounts than the nickel oxide and are partially dissolved within the liquid phase during the final liquid phase sintering step. Within the resultant sintered article, these oxides are found within the sintered portion which was liquid phase and do not harm the mechanical properties of the final article.

The third step, represented by "Step 3" in FIG. 1, is the homogenization step. Although some densification and homogenization of the compacts begin during the previous step when extended holding at the previous temperature occurs, full homogenization is not achieved due to the decrease in diffusion rates resulting from the reduced concentration gradient within the compact. Generally, the concentration gradient within a multi-component system is the driving force for the diffusion processes, i.e., sintering. During homogenization at a given temperature, the concentration gradient decreases with time as the elemental concentration becomes more uniform throughout the compact. This in turn slows down the diffusion rate. Therefore, from the previous step, an increase in temperature will again increase the mobility of the atoms within the compact thereby increasing the rate of diffusion so as to ensure a uniform composition throughout. This step ensures that the final sintered article will have a homogeneous composition throughout, and heating to the final sintering step without this homogenization step would result in the formation of a non-equilibrium liquid phase which solidifies during exposure to the sintering temperature, thereby producing a large amount of porosity within the sintered article.

Therefore, a homogenization step for about sixty minutes is preferred at a temperature close to, but lower than, the solidus temperature of the alloy. This temperature depends on the alloy composition of the compact and was approximately 1290° C. for the composition described above wherein the ratio of the ductile nickel to prealloyed powder was about three. With the preferred ratios of nickel to prealloyed powder, as described above, the homogenization temperature would range from about 1250° C. to about 1300° C. Grain growth during this homogenization step is negligible and the residual porosity after homogenization was approximately 12%. Most of the shrinkage within the compact occurs during this step.

It is noted that all of the processing steps occur in the vacuum environment, because the final sintering step is accomplished without pressure and since there are no cool down steps between each of the processing steps. In addition, the rate at which the temperature is elevated to each subsequent step will vary depending on the volume of compacts within the furnace, but for this study a heating rate of about 10° C. per minute was sufficient to ensure uniform heating of the compact.

The final step represented by "Step 4" in FIG. 1, is a liquid phase sintering step. The amount of liquid phase within the compact strongly influences the final porosity present after sintering is completed. The amount of liquid phase present within the compact was conventionally estimated from the liquidus and solidus surfaces from the ternary Ni-Al-Ti phase diagram. For alloy compositions consisting of the phases $Ni_3(Al,Ti)$ and $Ni_2AlTi$ and/or Ni(Al,Ti), the $Ni_3(Al,Ti)$ phase becomes the liquid phase during sintering.

Figure 2:
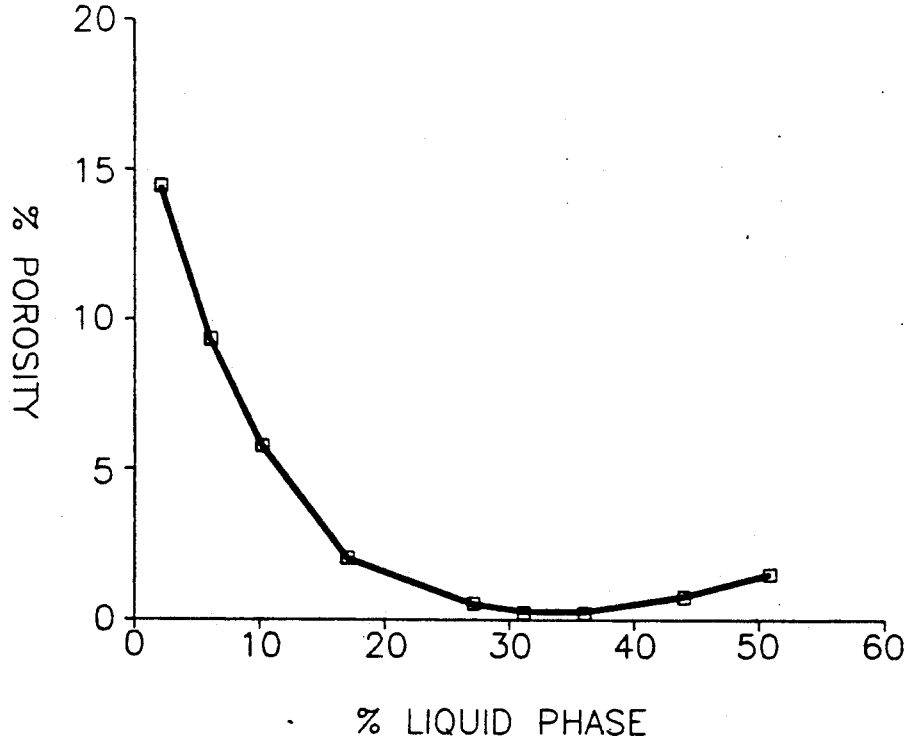
FIG. 2 is a diagram showing the relationship between residual porosity in the sintered article and the amount of liquid phase present during sintering of that article when using the method of this invention.

Sintering at a temperature at which about 30 to about 35 percent liquid phase forms, i.e., approximately 1320° C. for the preferred composition having three times the weight of ductile nickel to weight of brittle prealloyed aluminide powder described above, results in a density close to theoretical with only about one percent to about two percent porosity. As shown in FIG. 2, residual porosity within the sintered article increases with both an increase and decrease of liquid phase from this preferred range. Therefore, the sintering temperature depends on the composition of the powder mixture employed, but for the preferred composition would range between about 1315° C. and 1325° C. It is expected that for the Ni-Al-Ti multiphase alloy compositions of interest, the sintering temperature could range from about 1300° C. to about 1350° C.

Liquid phase sintering is characterized by generally three different stages of activity. First, as the temperature reaches the liquidus/solidus line for the material, local melting occurs within the compact. This forces the rearrangement of solid particles, while concurrently allowing the penetration of liquid into the particle interfaces. Typically this stage can last from a few seconds to a few minutes after reaching the liquidus/solidus temperature.

Next, the presence of some localized melting will cause the concentration gradient between the liquid and solid phases to be great. Therefore, the diffusion processes will be active so as to equalize the concentration gradient throughout the article. During this stage, solutionizing and reprecipitation of components will occur to achieve chemical equilibrium between the phases. This stage can last from a few minutes to a few hours depending on the temperature and compositions.

The third stage begins when the system reaches chemical equilibrium. During this stage coarsening of the grains occurs. The driving force during this stage is the reduction of thermodynamic free energy within the system which results in the reduction of surface area of the grains. Consequently, the formation of coarse grains occurs during this stage. Depending on the desired grain size, the duration at the liquid phase sintering temperature may vary, and is discussed more fully later.

It is to be noted that the presence of an insufficient amount of liquid phase within the system during this liquid phase sintering step will result in a low rate of diffusion since the liquid phase fosters the movement of atoms between the particles, and also an insufficient amount of surface tension to produce a fully porous sintered article. In addition, if there is too great an amount of liquid phase, the system will not have the required surface tension for densifying the article either. Therefore for the material of this invention, a liquid phase of about 30–35 volume percent optimized these competing concerns.

After sintering the compacts were furnace cooled within the vacuum chamber.

Visual examination of the sintered articles, wherein the compacts were pressureless sintered in accordance with the preferred steps described above, indicated excellent retention of geometry, a shiny and smooth surface, and uniform shrinkage throughout the article. Metallographic examination showed a uniform, fine grained, substantially two-phase microstructure consisting of $Ni_2AlTi$ (as well as some Ni(Al,Ti)) and $Ni_3(Al,Ti)$. Compression tests indicated exceptional room temperature ductility of about 15% and a high yield strength of about 87,000 psi at about 1600° F.

The grain size after sintering is highly dependent on the soaking time during liquid phase sintering. For example, sintering for about sixty minutes at a temperature at which 30–35% liquid phase is present, results in a grain size about three times larger than that produced by sintering for about 20 minutes. In addition, if higher porosity can be tolerated, a very fine grain size may be obtained by lowering the liquid phase sintering temperature, which therefore correspondingly lessens the amount of liquid phase present during sintering. Sintering at a temperature at which about 5 to about 15 percent liquid phase is present results in a grain size of about five times smaller than sintering at a higher temperature at which 30–35% liquid phase forms.

The developed powder metallurgy process may be used to produce near-theoretical density and near-net shape articles of multiphase Ni-Al-Ti alloys consisting of $Ni_2AlTi$ and/or Ni(Al,Ti), and $Ni_3(Al,Ti)$. Samples of various geometry, e.g., rectangular bars, thin strips, cylinders, thin rings, and tensile bars, have been produced with excellent retention of geometry. Representative test bars exhibited 98 to about 99.6 percent of theoretical density. The quality of bodies fabricated according to the method of this invention depends on proper execution of all procedures. Close control of the nickel and master alloy powder size, with most particles in the range of about 2–8 microns, is also recommended to ensure a small initial pore size and active diffusion process during sintering.

In addition, acceptable compressibility and green strength of the compact appear to depend on the ratio of the weight of the ductile nickel to the weight of the brittle Ni-Al-Ti prealloyed powder within the powder mixture, and is preferably greater than or equal to about 1.5.

Further, although nickel is preferred, it is foreseeable that other elemental powders could be substituted for its use such as cobalt or less ductile molybdenum or tungsten powders, as well as others. The requirement would be that (1) the element must have a partial pressure of oxygen, for their oxide formation as represented by Step 2 of this invention, higher than the partial pressure of oxygen employed during step 2 which in this case is a fairly hard vacuum; and (2) the element and the second component must form a sufficient amount of liquid phase during the sintering steps. In addition, the second component, although it is preferred that they are the nickel and titanium aluminides, may be prealloyed combinations of niobium-aluminide, hafnium-aluminide or tantalum aluminide as well as others. But, again the particular components used must form a sufficient amount of liquid phase during the sintering steps. Also, if the components are modified, the actual processing steps would need to be adjusted.

In summary, the four step pressureless sintering process of this invention ensures maximum degassing, eliminates the surface nickel oxide prior to sintering, homogenizes the alloy so as to ensure a uniform distribution of phases within the sintered body, and finally completely densifies the article by liquid phase sintering. The nickel oxide reduction and homogenization steps are essential to the success of the liquid phase sintering process of this invention.

The method of this invention is characterized by several advantages. High green strength of the compact is obtained without the use of binders which would have to be removed by complex treatment prior to final sintering. In addition, the resultant sintered articles are near-net shape and near-theoretical density. The key to achieving near-net shape and near-theoretical density is the proper execution of all processing steps and the formation of a critical amount of liquid phase during sintering, of about 30 to 35 volume percent. The method of this invention should eliminate costly machining and facilitate production of components from the multiphase Ni-Al-Ti alloys for use in high temperature applications, such as advanced engines.

Therefore, while our invention has been described in terms of a preferred embodiment, it is apparent that other forms could be adopted by one skilled in the art, such as by modifying the proportions of nickel, aluminum and titanium within the powdered mixtures, or by modifying the processing parameters such as the processing temperatures or durations, or by employing cobalt, molybdenum or tungsten instead of the nickel, or by employing the powdered alloys in an alternative environment. Accordingly, the scope of our invention is to be limited only by the following claims.

The embodiments of the invention in which an exclusive property or privilege is claimed are defined as follows:

1. A method for producing sintered articles of multiphase intermetallic alloys which are characterized by near-theoretical density and near-net shape, comprising the following steps:

blending a powdered mixture, said powdered mixture comprising nickel powder and a prealloyed powder containing aluminum and at least one metal chosen from the group consisting of nickel and titanium, wherein the ratio of said nickel powder to said prealloyed aluminum-containing powder is at least 1.5 but not greater than about 3.5;

compacting said powdered mixture at a pressure sufficient to form a compact of said powdered mixture;

degassing said compact by heating in a vacuum to a first temperature and for a duration sufficient to diffuse internal gases from said compact, said first temperature and duration being insufficient to cause substantial diffusion of the elements within said compact;

heating said compact to a second temperature within said vacuum, wherein said second temperature is greater than said first temperature, and wherein said duration and said vacuum pressure are sufficient to permit the chemical decomposition of nickel oxide within said compact to nickel and oxygen gas;

homogenizing said compact at a third temperature within said vacuum, wherein said third temperature is greater than said second temperature but not greater than the solidus temperature of said powdered mixture, and wherein said duration at said third temperature is sufficient to uniformly diffuse said elements within said compact while substantially increasing the density of said compact; and sintering said homogenized compact at a fourth temperature within said vacuum, wherein said fourth temperature is greater than said third temperature, and wherein the duration at said fourth temperature is sufficient for said aluminum to react with said other metals so as to form at least one aluminide phase, and sufficient to liquify a portion of said aluminide phases, thereby resulting in a sintered article containing a uniform distribution of fine particles of said intermetallic aluminide phases, and said sintered article being characterized by less than about two percent porosity.

2. A method for producing sintered articles of multiphase intermetallic alloys as recited in claim 1 wherein said degassing step occurs at a temperature ranging from about 950° C. to about 1050° C.

3. A method for producing sintered articles of multiphase intermetallic alloys as recited in claim 1 wherein said second temperature ranges from about 1100° C. to about 1200° C.

4. A method for producing sintered articles of multiphase intermetallic alloys as recited in claim 1 wherein said homogenizing step occurs at a temperature ranging from about 1250° C. to about 1300° C.

5. A method for producing sintered articles of multiphase intermetallic alloys as recited in claim 1 wherein said sintering step occurs at a temperature ranging from about 1300° C. to about 1350° C.

6. A method for producing sintered articles of multiphase intermetallic alloys as recited in claim 1 wherein said liquified portion during said sintering step is approximately 30 to 35 volume percent of said aluminide phases.

7. A method for producing sintered articles of multiphase Ni-Al-Ti intermetallic alloys which are characterized by near-theoretical density and near-net shape, comprising the following steps:

blending a powdered mixture, said powdered mixture comprising nickel powder in a ductile form and a prealloyed brittle powder containing aluminum and at least one metal chosen from the group consisting of nickel and titanium, wherein the ratio of said nickel powder to said prealloyed aluminum-containing powder is at least 1.5 but not greater than about 3.5;

compacting said powdered mixture at a pressure sufficient to form a compact of said powdered mixture, said compact having a density about 60% to 65% as compared to a theoretical density of a porosity-free compact of said powdered mixture;

degassing said compact by heating in a vacuum to a first temperature ranging from about 950° C. to about 1050° C. for a duration sufficient for any internal gases to diffuse from of said compact, said first temperature and duration being insufficient to cause substantial diffusion of the elements within said compact;

heating said compact to a second temperature and for a second duration within said vacuum, wherein said second temperature ranges from about 1100° C. to about 1200° C. and wherein said duration and said vacuum pressure are sufficient to permit the chemical decomposition of any nickel oxide within said compact to nickel and oxygen gas;

homogenizing said compact at a third temperature within said vacuum, wherein said third temperature ranges from about 1250° C. to about 1300° C. but is not higher than the solidus temperature of said powdered mixture, and wherein said duration at said third temperature is sufficient to uniformly diffuse said elements within said compact while substantially increasing the density of said compact; and sintering said homogenized compact at a fourth temperature within said vacuum, wherein said fourth temperature ranges from about 1300° C. to about 1350° C., and wherein the duration at said fourth temperature is sufficient for said aluminum to react with said metals to form at least one aluminide phase, and sufficient to liquify a portion of said aluminide phases, thereby resulting in a sintered article containing a uniform distribution of said aluminide phases and said sintered article being characterized by less than about two percent porosity.

8. A method for producing sintered articles of multiphase intermetallic alloys as recited in claim 7 wherein said liquified portion during said sintering step is approximately 30 to 35 volume percent of said aluminide phases.

9. A sintered article formed of a multiphase Ni-Al-Ti intermetallic alloy which is suitable for use in high temperature applications, wherein said multiphase Ni-Al-Ti intermetallic alloy is formed by the method comprising the following steps:

blending a powdered mixture, said powdered mixture comprising nickel powder in a ductile form and a prealloyed brittle powder containing aluminum and at least one metal chosen from the group consisting of nickel and titanium, wherein the ratio of said nickel powder to said prealloyed aluminum-containing powder is at least 1.5 but not greater than about 3.5;

compacting said powdered mixture at a pressure sufficient to form a compact of said powdered mixture, said compact having a density about 60% to 65% as compared to a theoretical density of a porosity-free compact of said powdered mixture;

degassing said compact by heating in a vacuum to a first temperature ranging from about 950° C. to about 1050° C. for a duration sufficient for any internal gases to diffuse from of said compact, said first temperature and duration being insufficient to cause substantial diffusion of the elements within said compact;

heating said compact to a second temperature and for a second duration within said vacuum, wherein said second temperature ranges from about 1100° C. to about 1200° C. and wherein said duration and said vacuum pressure are sufficient to permit the chemical decomposition of any nickel oxide within said compact to nickel and oxygen gas;

homogenizing said compact at a third temperature within said vacuum, wherein said third temperature ranges from about 1250° C. to about 1300° C. but is not higher than the solidus temperature of said powdered mixture, and wherein said duration at said third temperature is sufficient to uniformly diffuse said elements within said compact while substantially increasing the density of said compact; and sintering said homogenized compact at a fourth temperature within said vacuum, wherein said fourth temperature ranges from about 1300° C. to about 1350° C., and wherein the duration at said fourth temperature is sufficient for said aluminum to react with said metals to form at least one aluminide phase, and sufficient to liquify a portion of said aluminide phases; thereby resulting in a sintered article containing a uniform distribution of said aluminide phases and said sintered article being characterized by less than about one percent porosity.

10. A sintered article formed of a multiphase Ni-Al-Ti intermetallic alloy which is suitable for use in high temperature applications as recited in claim 9 wherein said liquified portion during said sintering step is approximately 30 to 35 volume percent of said aluminide phases.

* * * * *